US007175473B1

(12) United States Patent
Clapp et al.

(10) Patent No.: US 7,175,473 B1
(45) Date of Patent: Feb. 13, 2007

(54) ELECTRICAL APPLIANCE POWER CORD STORAGE MODULE

(75) Inventors: Larry Daniel Clapp, Chesterfield, VA (US); Martin Patrick Brady, Richmond, VA (US)

(73) Assignee: Hamilton Beach/Proctor-Silex, Inc., Glen Allen, VA (US)

( * ) Notice: Subject to any disclaimer, the term of this patent is extended or adjusted under 35 U.S.C. 154(b) by 0 days.

(21) Appl. No.: 11/293,772

(22) Filed: Dec. 2, 2005

(51) Int. Cl.
*H01R 13/72* (2006.01)

(52) U.S. Cl. ..... 439/501; 191/12.2 R

(58) Field of Classification Search ..... 439/4, 439/501; 191/12.2 R, 12.4
See application file for complete search history.

(56) References Cited

U.S. PATENT DOCUMENTS

| | | | | |
|---|---|---|---|---|
| 1,082,068 | A | 12/1913 | Clements | |
| 1,754,162 | A | 4/1930 | Colegrove | |
| 2,033,491 | A | 3/1936 | Sprague, et al. | |
| 2,193,989 | A | 3/1940 | Smellie | |
| 2,573,636 | A | 10/1951 | Wilson | |
| 3,476,331 | A | 11/1969 | Green, Jr., et al. | |
| 5,056,698 | A | 10/1991 | Kozakevich | |
| 5,923,146 | A * | 7/1999 | Martensson | 320/111 |
| 6,003,804 | A | 12/1999 | Vara | |
| 6,059,081 | A * | 5/2000 | Patterson et al. | 191/12.2 R |
| 6,253,893 | B1 * | 7/2001 | Chi-Min | 191/12.4 |
| 6,439,360 | B1 * | 8/2002 | Miller | 191/12.2 R |
| 6,942,080 | B2 * | 9/2005 | Chi | 191/12.4 |

* cited by examiner

*Primary Examiner*—Thanh-Tam Le
(74) *Attorney, Agent, or Firm*—Akin Gump Strauss Hauer & Feld, LLP

(57) ABSTRACT

A power cord storage module for an electrical device includes at least one fixed member forming a winding surface. A movable member moves relative to the fixed member between a retracted position and an extended position. The movable member includes a skirt. With the movable member in the extended position, the winding surface is accessible to allow the power cord to be manually wrapped upon or unwrapped from the winding surface. With the movable member in the retracted position and the power cord wrapped upon the winding surface, the skirt at least substantially covers the power cord.

19 Claims, 4 Drawing Sheets

ELECTRICAL APPLIANCE POWER CORD STORAGE MODULE

BACKGROUND OF THE INVENTION

The present invention relates to electrical devices generally, and more particularly to power cord storage devices used in combination with electrical devices, such as electrical home appliances.

It is known to provide a power cord storage device as part of an electrical device such as an electrical home appliance. For example, it is known to form a cord storage chamber in a housing of a base of an electrical appliance. A central reel is formed within the cord storage chamber. The central reel includes an exterior cylindrical surface upon which a power cord of the electrical appliance may be wrapped. Ears extend from the central reel beyond the exterior cylindrical surface to aid in retaining the power cord on the central reel by preventing the cord from sliding off of the cylindrical surface. While this approach is functional, it can prove awkward to use. The power cord must be threaded between the ears and an outer wall of the cord storage chamber to be either reeled upon or reeled from the central reel. A power cord storage device having a movable cover providing ready radial access to the reel wrapping surface to facilitate the process of wrapping and unwrapping the power cord, along with providing a covered storage compartment for the power cord when not in use, would be desirable.

BRIEF SUMMARY OF THE INVENTION

Briefly stated, a preferred embodiment of the present invention is directed to an electrical device comprising a power cord and a power cord storage module including a spool assembly connected to a remainder of the electrical device. The spool assembly includes a spool and a guide member sized and shaped to fit within the spool. The guide member is supported by the spool for movement between a fully retracted position and a fully extended position. A cover member is connected to the guide member and is provided with an outer skirt. With the guide member in the fully extended position, the spool is accessible to allow the power cord to be manually wrapped upon or unwrapped from an exterior surface of the spool. With the guide member in the fully retracted position, the outer skirt at least substantially covers the power cord wrapped upon the spool.

In another aspect, a preferred embodiment of the present invention is directed to an electrical device comprising a power cord and a power cord storage module including at least one fixed member forming a winding surface. The at least one fixed member is fixedly connected to a remainder of the electrical device. A movable member is slidably connected to the remainder of the electrical device for movement relative to the fixed member between a retracted position and an extended position. The movable member includes a skirt. With the movable member in the extended position, the winding surface is accessible to allow the power cord to be manually wrapped upon or unwrapped from the winding surface. With the movable member in the retracted position, the skirt at least substantially covers the power cord wrapped upon the winding surface.

BRIEF DESCRIPTION OF THE SEVERAL VIEWS OF THE DRAWINGS

The foregoing summary as well as the following detailed description of preferred embodiments of the present invention will be better understood when read in conjunction with the appended drawings. For the purpose of illustrating the invention, there is shown in the drawings an embodiment which is presently preferred. It is understood, however, that the invention is not limited to the precise arrangements and instrumentalities shown. In the drawings.

DETAILED DESCRIPTION OF THE INVENTION

Figure 1:
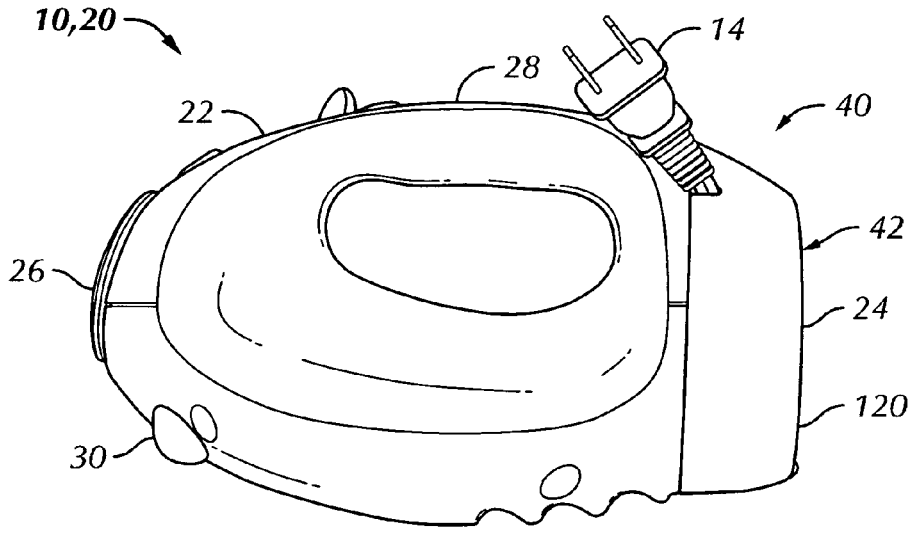
FIG. 1 is side elevational view of an electrical device having a power cord storage module in accordance with a preferred embodiment of the present invention, shown with a cover member of the power cord storage module in a retracted position.

Certain terminology is used in the following description for convenience only and is not limiting. The words, "right," "left," "lower" and "upper" designate directions in the drawings to which reference is made. The words "inwardly" and "outwardly" refer to directions toward and away from, respectively, the geometric center of the electrical device power cord storage module and designated parts thereof. The terminology includes the words above specifically mentioned, derivatives thereof and words of similar import. Additionally, the word "a", as used in the specification, means at least one.

Referring to the drawings in detail, wherein like numerals indicate like elements throughout, there is shown in FIGS. 1–5 a preferred embodiment of a power cord storage module 40 for use with an electrical device, generally designated 10. The electrical device 10 includes a power cord 12 having a plug 14. Except for being adapted to connect to the power cord storage module 40, the electronic device 10 is otherwise conventional.

Figure 2:
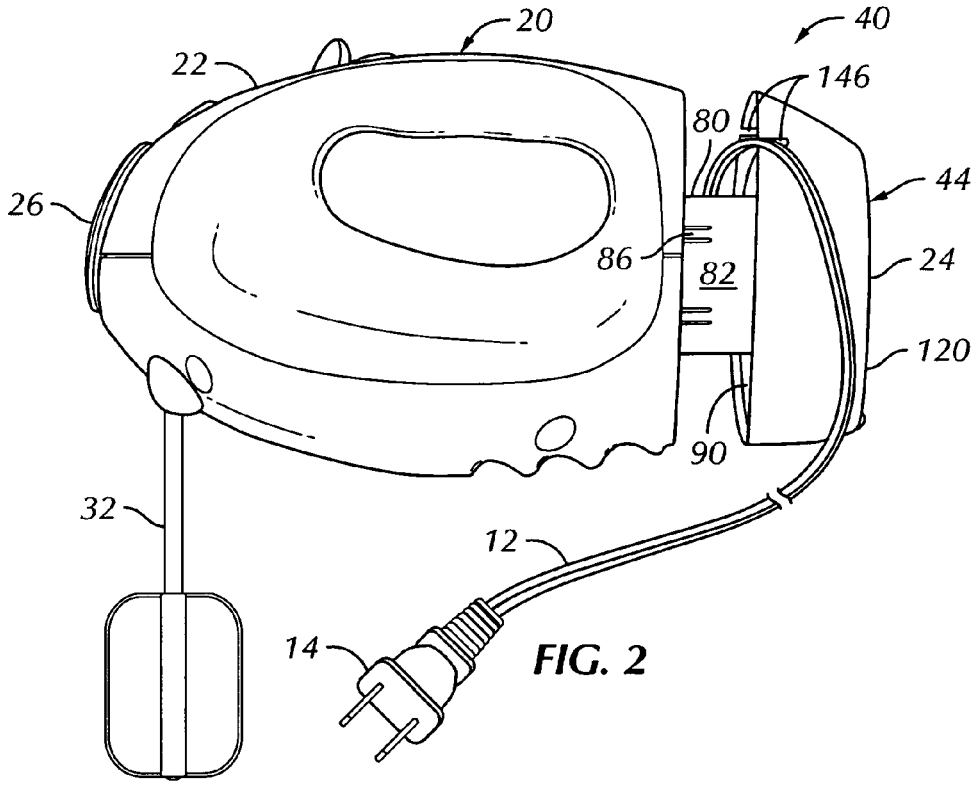
FIG. 2 is a side elevational view of the electrical device of FIG. 1, shown with the cover member in an extended position, and shown with beater attachments connected to the device.

With particular reference to FIGS. 1 and 2, the electrical device 10 is illustrated to be a hand mixer 20, but it will be understood that the power cord storage module 40 could be incorporated into other electrical devices, for example, hand tools having a power cord or other home appliances, for example, blenders and coffee bean grinders. The hand mixer 20 illustrated has a body 22 with a first end 24 and a second end 26. The hand mixer 20 is provided with a handle 28 and mixer blade attachment openings 30. Mixer blades or beaters 32 may be releasably connected to the hand mixer 20 via the mixer blade attachment openings 30.

Figure 4:
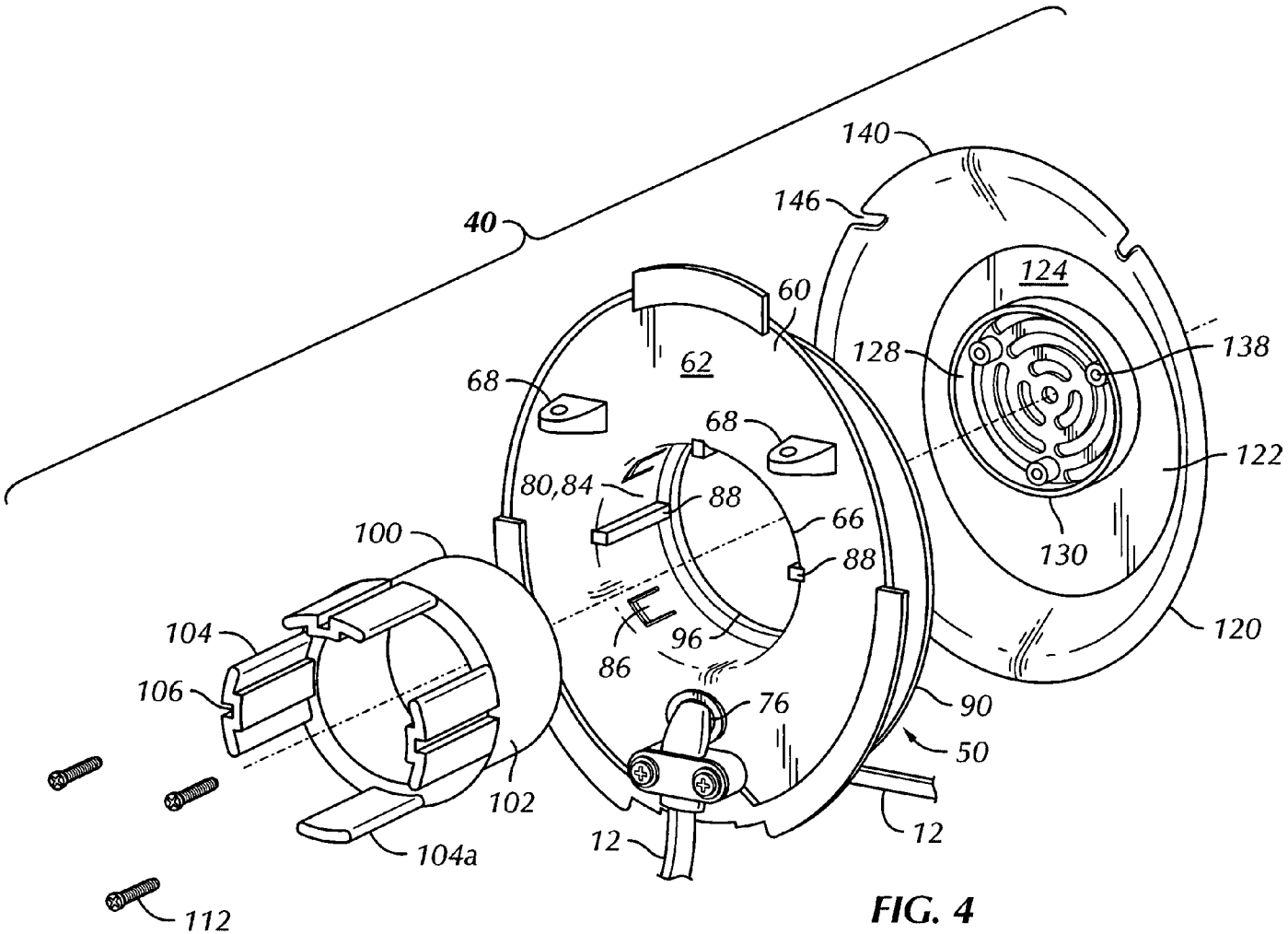
FIG. 4 is an exploded perspective view of the power cord storage module of FIG. 1, shown detached from a remainder of the electrical device.

With reference now to FIGS. 1, 2, and 4, the power cord storage module 40 includes a spool assembly 50, a guide member 100, and a cover member 120. In the embodiment illustrated, the cover member 120 forms the first end 24 of the hand mixer 20. The cover member 120 is moveable between a retracted position 42 (shown in FIG. 1) and an extended position 44 (shown in FIG. 2). With the cover 120 in the extended position 44, the power cord 12 may be readily wound upon an exterior winding surface 82 of a spool 80 with unobstructed radial access to the winding surface 82. With the power cord 12 wound on the spool 80, the cover 120 may be moved to the retracted position 42, to at least substantially cover the power cord 12. Preferably, the cover member 120 is provided with one or more cord cutouts 146, allowing the cord 12 including the plug 14 to extend outside the cover member 120 with the cover member 120 in the retracted position 42.

Figure 3:
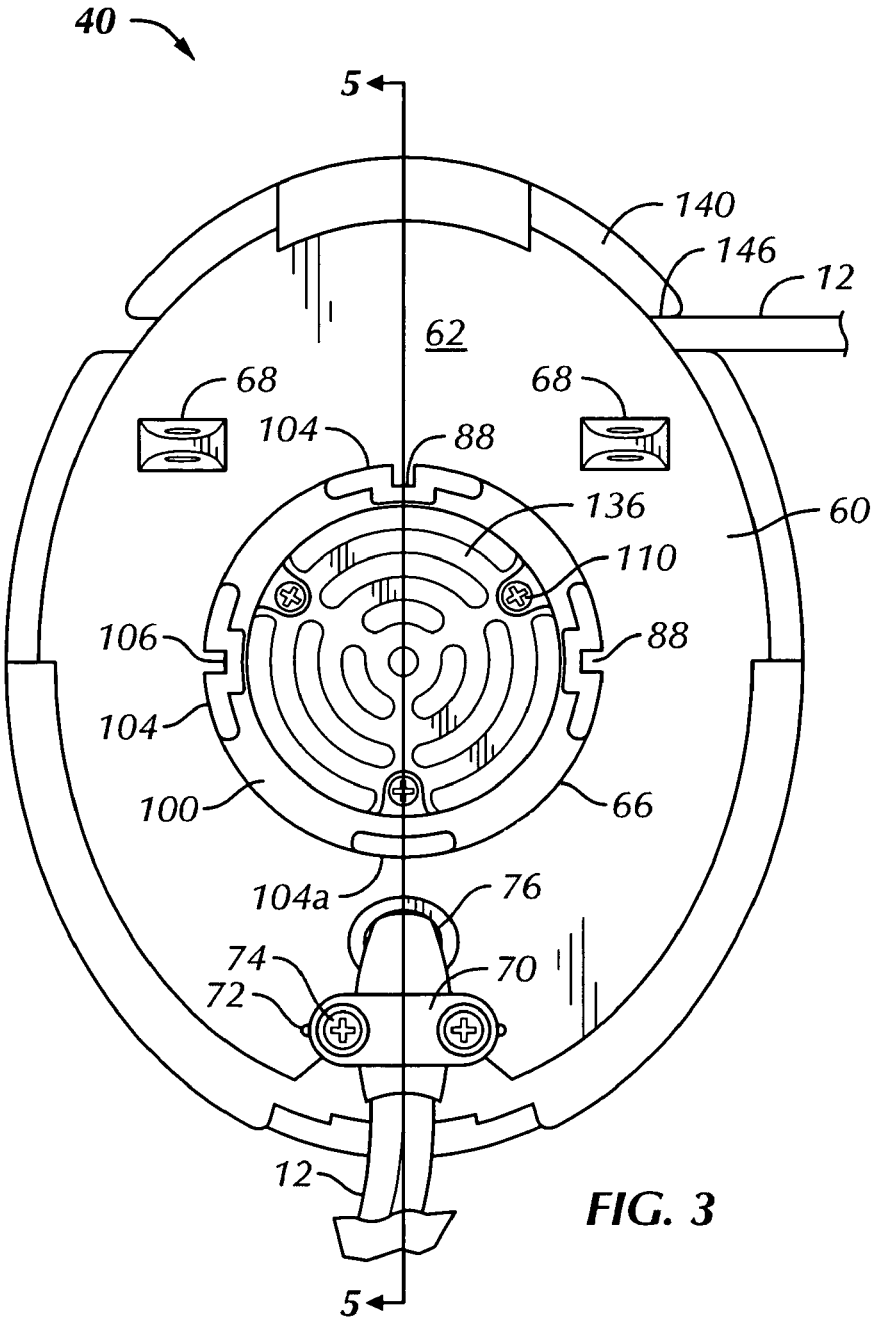
FIG. 3 is a front view of the power cord storage module of FIG. 1, shown detached from a remainder of the electrical device to expose an interior surface which abuts a remainder of the electrical device when the power cord storage module is connected to the remainder of the electrical device.
Figure 5:
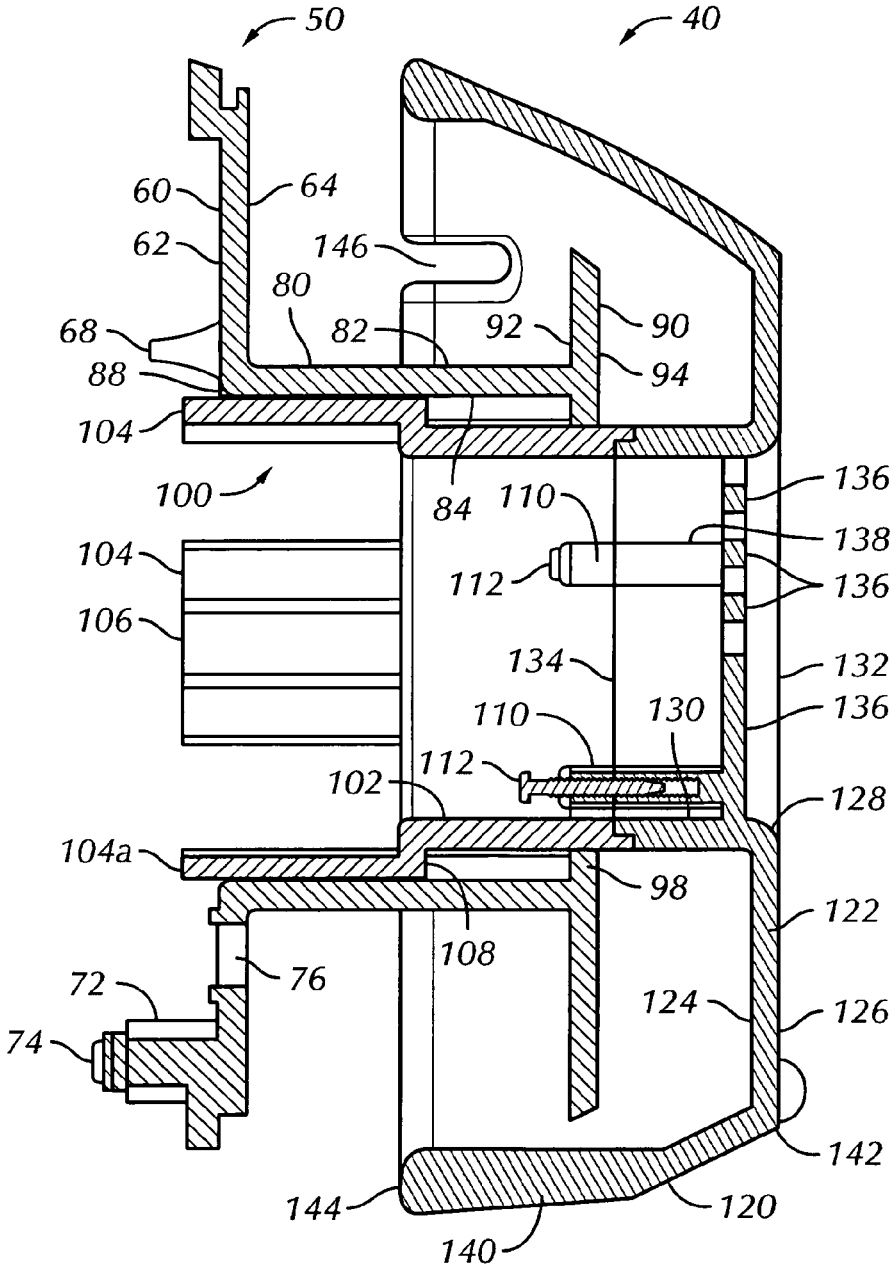
FIG. 5 is a cross-section view of the power cord storage module of FIG. 1, taken along line 5—5 of FIG. 3 (shown with the power cord omitted for clarity).

With particular reference now to FIGS. 3–5, the spool assembly 50 includes a first plate 60, a spool 80, and a second plate 90. The first and second plates 60, 90 are each provided with a central opening 66, 96, respectively, proximate which the first and second plates 60, 90 are fixedly connected to the spool 80. Preferably, the spool assembly 50 is formed as a single, unitary component, as illustrated in FIGS. 4 and 5 but it could be formed of multiple pieces without departing from the spirit and scope of the invention.

The first plate 60 has a first surface 62 and a second surface 64. At least one, and preferably two or more connection bosses 68 extend from the first surface 62, and have holes to receive screw fasteners (not shown). The spool assembly 50 is fixedly connected to a remainder of the hand mixer 20 by the screw fasteners and connection bosses 68. A cord penetration 76 extends through the first plate 60, allowing the cord 12, connected to a motor (not shown) within the electrical device 12, to pass from an interior of the electrical device 10 through the first plate 60, to an exterior of the electrical device 10 for connection to an electrical outlet (not shown). Preferably, the cord 12 is held securely in place by a cord clamp plate 70 attached to cord clamp bosses 72 extending from the first surface 62 using cord clamp screws 74.

The spool 80 includes an exterior surface 82 and an interior surface 84. The spool interior surface 84 is provided with at least one, and preferably a plurality of linear guides 88. Operation of the linear guides 88 is described herein below.

At least one, and preferably a plurality of retaining tangs 86 are also formed in the spool 80. With the guide member 100 in the fully retracted position 42, a retaining ledge 108 of the guide member 100 engages each of the tangs 86 on the spool interior surface 84 to releasably hold the guide member 100 in the retracted or closed position 42. A modest axial force is required to pull the retaining ledge 108 and retaining tang 86 out of engagement and move the guide member 100 and cover member 120 out of the retracted position 42. Alternatively, the guide member 100 and cover member 120 could be retained in the retracted position 42 using other inter-engaging structures. For example, inter-engaging protrusions and detents formed on the guide member 100 and spool 80 in any number of configurations and positions could also be used.

The second plate 90 also has a first surface 94 and a second surface 92. With the cover member 120 in the retracted position 42, the cover member 120 contacts the first surface 94, limiting further movement of the cover member 120. A guide stop 98 extends from the second plate 90 radially inwardly, forming the second plate central opening 96. The guide stop 98 engages the retaining ledge 108 of the guide member 100 with the cover member 120 in the fully extended position 44, thus preventing further movement of the guide member 100 and cover member 120.

The guide member 100 includes a cylindrical base 102 sized and shaped to be slidingly received within the second plate central opening 96. The guide member 100 further includes at least one, and preferably a plurality, of guide panels 104 extending from an edge of the base 102. The retaining ledge 108 is formed at the juncture of the guide panels 104 and the base 102. The guide panels 104 each include a guide track 106. Preferably, a single guide panel 104*a* is not provided with a guide track 106. The guide tracks 106 slidingly receive the spool linear guides 88, each acting as a keyway in which is received the key formed by each of the linear guides 88, to guide movement of the guide member 100 (and the cover member 120 fixedly connected to the guide member) relative to the spool assembly 50. At least one, and preferably a plurality, of fastener bosses 110 extend radially inwardly from the base 102. Fasteners 112 may be installed through the guide member fastener bosses 110 into mating cover member fastener bosses 138 connected to a remainder of the cover member 120 to connect the guide member 100 to the cover member 120.

The cover member 120 includes a base plate 122, having an interior side 124 and an exterior side 126. The base plate 122 is sized and shaped to stably support the hand mixer 20 with the base plate 122 resting on a supporting surface. A central opening 128 is formed in the base plate 122. A cylindrical member 130 extends from the interior side 124 of the base plate 122 along the central opening 128. The cylindrical member 130 has a first edge 132 and a second edge 134. A vent grill 136 covers the central opening 128. The guide member fastener bosses 138 may be connected to either the cylindrical member 130 or the vent grill 136 or both. With the cover member 120 connected to the guide member 100, cylindrical member second edge 134 engages a lower edge of the base 102.

The cover member 120 further includes an outer skirt 140 having a first edge 142 and a second edge 144. Along first edge 142, the outer skirt 140 is connected to the base plate 122. The second edge 144 extends away from the base plate interior side 124. At least one, and preferably a plurality of the cord cutouts 146 are formed in the second edge 144. With the cover member 120 in the retracted position 42, the outer skirt 140 at least substantially, and preferably fully covers the cord 12 when the cord 12 is wrapped upon the spool 80.

The guide member 100 and cover member 120 thus form a movable member which is connected to, and movable relative to, the fixed spool assembly 50. In the illustrated embodiment, for purposes of ease of manufacturing and assembly, the movable member is shown to include two separate components, namely, the guide member 100 and cover member 120.

The spool assembly 50, guide member 100, and cover member 120 are all preferably fabricated from a polymeric material, such as acrylonitrile butadiene styrene copolymer (ABS), using conventional manufacturing techniques such as injection molding. However, other materials and manufacturing techniques could be used without departing from the spirit and scope of the invention.

In use, the cover member 120, and the guide member 100 to which it is connected, is movable between the retracted position 42 and the extended position 44. With the cover member 120 in the extended position 44, and the cord 12 unwrapped from the power cord storage module, the spool exterior winding surface 82 is exposed and accessible without radial obstruction for manually wrapping the cord 12 onto the spool assembly 50. Similarly, with the cover member 120 in the extended position 44 and the cord 12 wrapped upon the spool 80, the cord 12 is exposed and accessible without radial obstruction for manually unwrapping the cord 12 from the spool assembly 50. With the cover member 120 in the retracted position 42 and the cord 12 wrapped upon the spool assembly 50, the cord 12, preferably with the exception of the plug 14, is housed within and covered by the cover member 120.

An electrical device is thus disclosed having a power cord storage module including a spool assembly fixedly connected to a remainder of the electrical device and a guide member and cover member movably connected to the spool assembly. With the cover member moved to an extended position, a user is provided with unobstructed radial access to a reel wrapping surface to facilitate the process of wrapping and unwrapping a power cord. With the cover member moved to a retracted position, the cord is substantially and tidily covered by the cover member. The cord storage module thus allows the cord to be conveniently and neatly organized and hidden in a compact manner.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention.

We claim:

1. An electrical device comprising:

a power cord, and a power cord storage module including:

a spool assembly connected to a remainder of the electrical device and including a spool;

a guide member sized and shaped to fit within the spool and supported by the spool for movement with respect to the spool between a fully retracted position and a fully extended position; and a cover member connected to the guide member and provided with an outer skirt, wherein with the guide member in the fully extended position, the spool is accessible to allow the power cord to be manually wrapped upon or unwrapped from an exterior surface of the spool, and with the guide member in the fully retracted position, the outer skirt at least substantially covers the power cord wrapped upon the spool.

2. The electrical device of claim 1, the spool assembly further including first and second plates each provided with a central opening, wherein the spool connects the central openings of the first and second plates.

3. The electrical device of claim 1, wherein the electrical device is a hand mixer.

4. The electrical device of claim 3, wherein the cover member forms a first end of the hand mixer device.

5. The electrical device of claim 4, the cover member including a base plate connected to the outer skirt, the base plate being sized and shaped to stably support the hand mixer with the base plate resting on a supporting surface.

6. The electrical device of claim 1, the spool having an interior surface provided with guides and the guide member having an exterior surface provided with guide tracks, wherein movement of the guide member relative to the spool member is guided by movement of the guides within the guide tracks.

7. The electrical device of claim 6, the guide member further including a base and a plurality of guide panels connected to the base, wherein the guide tracks are formed in the guide panels.

8. The electrical device of claim 1, the spool having a guide stop and the guide member having a retaining ledge, wherein movement of the guide member into the fully extended position is limited by engagement of the retaining ledge with the guide stop.

9. The electrical device of claim 1, the outer skirt including a cutout sized and shaped to allow the power cord to pass through the cutout.

10. The electrical device of claim 1, the spool having at least one retaining tang positioned to releasably engage the guide member with the guide member in the fully retracted position.

11. The electrical device of claim 1, the spool assembly including a connection boss sized and shaped to receive a fastener for connecting the power cord storage device to the electrical device.

12. The electrical device of claim 1, the cover member further including a central opening.

13. The electrical device of claim 12, the cover member further including a vent grill covering the central opening.

14. An electrical device comprising:

a power cord, and a power cord storage module, including:

at least one fixed member forming a winding surface, the at least one fixed member fixedly connected to a remainder of the electrical device; and a movable member slidably connected to the remainder of the electrical device for movement relative to the fixed member between a retracted position and an extended position, the movable member including a skirt, wherein with the movable member in the extended position, the winding surface is accessible to allow the power cord to be manually wrapped upon or unwrapped from the winding surface, and with the movable member in the retracted position, the skirt at least substantially covers the power cord wrapped upon the winding surface.

15. The electrical device combination of claim 14, wherein the at least one fixed member is a cylindrical tube.

16. The electrical device combination of claim 14, wherein the movable member is connected to the remainder of the electrical device through the at least one fixed member.

17. The electrical device combination of claim 14, wherein the electrical device is a hand mixer.

18. The electrical device combination of claim 17 wherein the movable member forms a first end of the hand mixer.

19. The electrical device combination of claim 18, the movable member including a base plate connected to the skirt, the base plate being sized and shaped to stably support the hand mixer with the base plate resting on a supporting surface.

* * * * *